US010941773B2

(12) United States Patent
Yamada et al.

(10) Patent No.: US 10,941,773 B2
(45) Date of Patent: Mar. 9, 2021

(54) SCROLL COMPRESSOR

(71) Applicant: Panasonic Intellectual Property Management Co., Ltd., Osaka (JP)

(72) Inventors: Sadayuki Yamada, Gunma (JP); Yusuke Imai, Shiga (JP); Atsushi Sakuda, Shiga (JP); Takashi Morimoto, Kyoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 186 days.

(21) Appl. No.: 16/079,001

(22) PCT Filed: Dec. 1, 2016

(86) PCT No.: PCT/JP2016/005039
§ 371 (c)(1),
(2) Date: Aug. 22, 2018

(87) PCT Pub. No.: WO2017/158665
PCT Pub. Date: Sep. 21, 2017

(65) Prior Publication Data

US 2019/0048874 A1 Feb. 14, 2019

(30) Foreign Application Priority Data

Mar. 16, 2016 (JP) ..... JP2016-051764

(51) Int. Cl.
*F04C 28/20* (2006.01)
*F04C 28/06* (2006.01)
(Continued)

(52) U.S. Cl.
CPC ..... *F04C 28/20* (2013.01); *F04C 18/0215* (2013.01); *F04C 18/0253* (2013.01);
(Continued)

(58) Field of Classification Search
CPC .. F04C 28/20; F04C 18/0215; F04C 18/0253; F04C 23/008; F04C 27/005; F04C 28/06;
(Continued)

(56) References Cited

U.S. PATENT DOCUMENTS 5,102,316 A * 4/1992 Caillat ..... F01C 19/08 418/55.5
5,192,202 A 3/1993 Lee
(Continued)

FOREIGN PATENT DOCUMENTS

EP 0 492 759 7/1992
JP 4-269388 A 9/1992
(Continued)

OTHER PUBLICATIONS

The Extended European Search Report dated Nov. 13, 2018 for the related European Patent Application No. 16894289.4, 8 pages.

*Primary Examiner* — Connor J Tremarche
(74) *Attorney, Agent, or Firm* — Hamre, Schumann, Mueller & Larson, P.C.

(57) ABSTRACT

A scroll compressor according to the present disclosure includes a partition wall that divides a sealed vessel into a high-pressure space and a low-pressure space, a non-orbiting scroll provided in the low-pressure space, an orbiting scroll that forms a compression chamber between the orbiting scroll and the non-orbiting scroll, and a rotational shaft. The scroll compressor further includes a main bearing that supports the orbiting scroll, an elastic body that biases one of the non-orbiting scroll and the orbiting scroll so as to separate the non-orbiting scroll and the orbiting scroll from each other, and a plurality of columnar members that are fixed at one ends of the columnar members and are movable at the other ends of the columnar members, and are disposed in a circumferential direction. The non-orbiting scroll or the orbiting scroll that is biased by the elastic body is movable
(Continued)

between the partition wall and the main bearing in an axial direction of the rotational shaft. The elastic body is disposed between the plurality of columnar members in the circumferential direction.

8 Claims, 10 Drawing Sheets

(51) Int. Cl.

| | |
|---|---|
| ***F04C 18/02*** | (2006.01) |
| ***F04C 27/00*** | (2006.01) |
| ***F04C 29/00*** | (2006.01) |
| ***F04C 23/00*** | (2006.01) |

(52) U.S. Cl.
CPC ..... *F04C 23/008* (2013.01); *F04C 27/005* (2013.01); *F04C 28/06* (2013.01); *F04C 29/0021* (2013.01); *F04C 2230/60* (2013.01); *F04C 2240/50* (2013.01); *F04C 2240/805* (2013.01)

(58) Field of Classification Search
CPC ..... F04C 29/0021; F04C 2230/60; F04C 2240/50; F04C 2240/805
USPC ..... 418/55.1
See application file for complete search history.

(56) References Cited

U.S. PATENT DOCUMENTS

| | | | | |
|---|---|---|---|---|
| 5,487,653 | A | 1/1996 | Lee | |
| 6,027,321 | A * | 2/2000 | Shim | F04C 23/008 418/1 |
| 6,257,852 | B1 | 7/2001 | Tarng et al. | |
| 2007/0110605 | A1 | 5/2007 | Masuda | |
| 2008/0038134 | A1 | 2/2008 | Masuda | |
| 2016/0348676 | A1 | 12/2016 | Ogata et al. | |

FOREIGN PATENT DOCUMENTS

| | | | | |
|---|---|---|---|---|
| JP | 11-182463 | | 7/1999 | |
| JP | 3068906 | | 5/2000 | |
| JP | 2015-209767 | | 11/2015 | |
| WO | 2005/064166 | | 7/2005 | |
| WO | 2015/081261 | A1 | 6/2015 | |
| WO | WO-2015081261 | A1 * | 6/2015 | F04C 18/0215 |

* cited by examiner

SCROLL COMPRESSOR

TECHNICAL FIELD

The present disclosure relates to a scroll compressor.

BACKGROUND ART

A sealed scroll compressor including a partition wall provided within a sealed vessel, a compression mechanism having a fixed scroll and an orbiting scroll in a low-pressure space partitioned with the partition wall, and a motor that orbits the orbiting scroll has been recently known. In such a compressor, a boss of the fixed scroll is fitted into a holding hole in the partition wall. A refrigerant compressed by the compression mechanism is ejected to a high-pressure space partitioned with the partition wall via an ejection port in the fixed scroll (Refer to, for example, Patent Literature 1).

In such a compressor, since the compression mechanism is disposed in the low-pressure space, during the operation of the compressor, a force is applied to the fixed scroll and the orbiting scroll so as to separate the fixed scroll and the orbiting scroll from each other.

For this reason, it has been proposed to provide seal faces between the fixed scroll and the orbiting scroll with a chip seal to improve the sealing performance of a compression chamber formed between the fixed scroll and the orbiting scroll.

However, to increase the efficiency of the compressor, it is preferred to omit the chip seal and apply a back pressure to the orbiting scroll or the fixed scroll. Thus, it has been proposed to apply a back pressure to press the fixed scroll onto the orbiting scroll, thereby improving the sealing performance of the compression chamber during the operation of the compressor (Refer to, for example, Patent Literature 2).

FIG. 11 is a longitudinal sectional view of a scroll compressor described in Patent Literature 2. Compressor 111 includes fixed scroll 301, orbiting scroll 401, and motor 801. Compression chamber 501 is formed between fixed scroll 301 and orbiting scroll 401.

However, in conventional compressor 111, fixed scroll 301 is pressed onto orbiting scroll 401 with self-weight as well. Accordingly, the sealing performance of compression chamber 501 is high during the stoppage as well as at the activation of compressor 111.

For this reason, complete compression starts in compression chamber 501 immediately after the activation, to impose a large compression load on motor 801. As a result, in the case of using a single-phase motor having a small starting torque as motor 801, it is disadvantageously difficult to activate compressor 111.

CITATION LIST

Patent Literature

Patent Literature 1: Unexamined Japanese Patent Publication No. H11-182463

Patent Literature 2: U.S. Pat. No. 3,068,906

SUMMARY OF THE INVENTION

The present disclosure provides a scroll compressor having an improved startability.

To solve the above-mentioned conventional problem, the scroll compressor of the present disclosure includes a partition wall that divides a sealed vessel into a high-pressure space and a low-pressure space, a non-orbiting scroll that is provided in the low-pressure space and is disposed adjacent to the partition wall, and an orbiting scroll that engages with the non-orbiting scroll, the orbiting scroll with a compression chamber defined between the orbiting scroll and the non-orbiting scroll. The scroll compressor further includes a rotational shaft that orbits the orbiting scroll, a main bearing that supports the orbiting scroll, an elastic body that biases one of the non-orbiting scroll and the orbiting scroll so as to separate the non-orbiting scroll and the orbiting scroll from each other, and a plurality of columnar members that are fixed at one ends of the columnar members and are movable at the other ends of the columnar members with respect to the main bearing and the non-orbiting scroll, the columnar members being disposed in a circumferential direction. The non-orbiting scroll or the orbiting scroll that is biased by the elastic body is movable between the partition wall and the main bearing in an axial direction of the rotational shaft. The elastic body is disposed between the plurality of columnar members in the circumferential direction.

Accordingly, at the activation of the compressor, since a gap is generated between the non-orbiting scroll and the orbiting scroll, complete compression is not achieved immediately after the activation to reduce a compression load. In this manner, the startability of the compressor can be improved.

In the scroll compressor of the present disclosure, the elastic body biases the fixed scroll and the orbiting scroll so as to separate the fixed scroll and the orbiting scroll from each other, to reduce the compression load at the activation. This can improve the startability of the compressor.

DESCRIPTION OF EMBODIMENT

Figure 1:
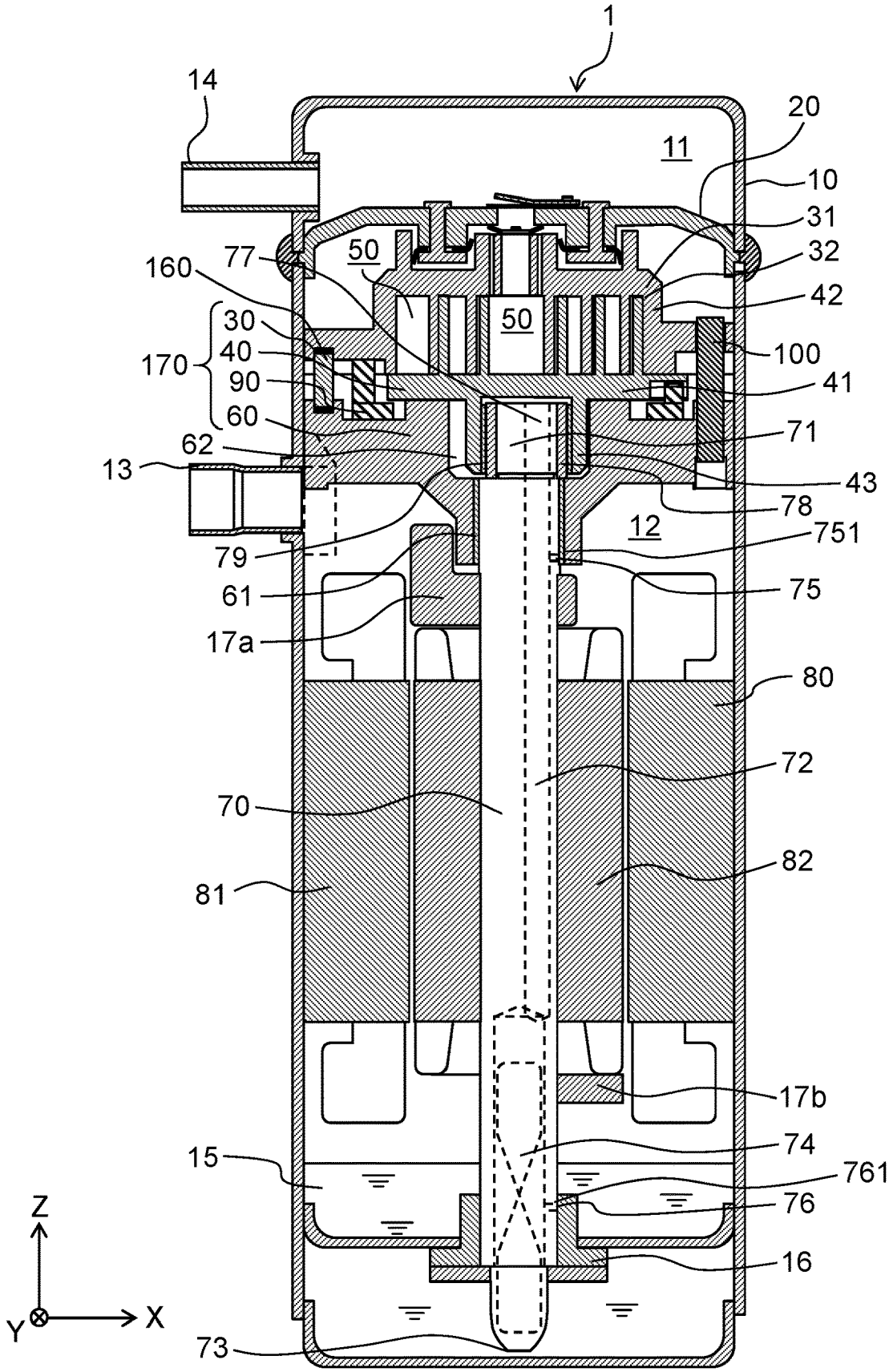
FIG. 1 is a longitudinal sectional view of a scroll compressor according to a first exemplary embodiment of the present disclosure.

A scroll compressor according to a first aspect includes a partition wall that divides a sealed vessel into a high-pressure space and a low-pressure space, a non-orbiting scroll that is provided in the low-pressure space and is disposed adjacent to the partition wall, and an orbiting scroll that engages with the non-orbiting scroll, the orbiting scroll with a compression chamber defined between the orbiting scroll and the non-orbiting scroll. The scroll compressor further includes a rotational shaft that orbits the orbiting scroll, a main bearing that supports the orbiting scroll, an elastic body that biases one of the non-orbiting scroll and the orbiting scroll so as to separate the non-orbiting scroll and the orbiting scroll from each other, and a plurality of columnar members that are fixed at one ends and are movable at the other ends with respect to the main bearing and the non-orbiting scroll, the columnar members being disposed in a circumferential direction. The non-orbiting scroll or the orbiting scroll that is biased by the elastic body is movable between the partition wall and the main bearing in an axial direction of the rotational shaft. The elastic body is disposed between the plurality of columnar members in the circumferential direction.

Accordingly, at the activation of the compressor, since a gap is generated between the non-orbiting scroll and the orbiting scroll, complete compression is not achieved immediately after the activation to reduce a compression load. This can improve the startability of the compressor.

According to a second aspect, in the first aspect, the plurality of elastic bodies are disposed. The plurality of columnar members are disposed at a regular first interval in the circumferential direction. The plurality of elastic bodies are disposed at a regular second interval in the circumferential direction.

Since the columnar members and the elastic bodies are disposed at the regular pitch, the gap between the non-orbiting scroll and the orbiting scroll can be stably generated. This can stably reduce the compression load to improve the startability of the compressor.

According to a third aspect, in the second aspect, the first interval is equal to the second interval.

According to a fourth aspect, in the second aspect, one end of each of the plurality of elastic bodies and one end of each of the plurality of columnar members are disposed at the main bearing so as to be close to each other.

This can reduce a radial length of a support part of the main bearing that supports the columnar members and the elastic bodies. As a result, lighter weight and lower costs can be achieved.

According to a fifth aspect, in the second or third aspect, an end face of each of the plurality of elastic bodies is disposed at the non-orbiting scroll and the main bearing. The end face is disposed in a recess formed in at least one of the non-orbiting scroll and the main bearing.

Thereby, the elastic bodies can be positioned by means of the recesses at arrangement, to improve the assembling operation. Further, the elastic bodies can be prevented from being detached during the operation of the compressor.

According to a sixth aspect, in the fifth aspect, the end face has a flat plate.

The end face of the elastic body has flat plate having a high wear resistance to improve the reliability.

An exemplary embodiment of the present disclosure will be described below with reference to the drawings. It is noted that the present disclosure is not limited to the exemplary embodiment.

First Exemplary Embodiment

FIG. 1 is a longitudinal sectional view of a scroll compressor according to the present exemplary embodiment. FIG. 1 illustrates a cross-section taken along line 1-1 in FIG. 3. As illustrated in FIG. 1, compressor 1 includes sealed vessel 10 having a tubular shape and a longitudinal direction that is a vertical direction, as an outer shell. In this specification, the vertical direction denotes a Z-axis direction in each of FIGS. 1 to 9.

Compressor 1 is a sealed scroll compressor including compression mechanism 170 for compressing a refrigerant and motor 80 for driving compression mechanism 170, within sealed vessel 10. Compression mechanism 170 includes at least fixed scroll 30 that is a non-orbiting scroll, orbiting scroll 40, main bearing 60, and Oldham ring 90.

Partition wall 20 that vertically partitions the inside of sealed vessel 10 is provided in an upper portion of the inside of sealed vessel 10. Partition wall 20 divides the inside of sealed vessel 10 into high-pressure space 11 and low-pressure space 12. High-pressure space 11 is a space filled with a high-pressure refrigerant compressed by compression mechanism 170. Low-pressure space 12 is a space filled with a low-pressure refrigerant that has not compressed by compression mechanism 170.

Sealed vessel 10 includes refrigerant suction tube 13 that communicates the outside of sealed vessel 10 with low-pressure space 12, and refrigerant ejection tube 14 that communicates the outside of sealed vessel 10 with high-pressure space 11. Compressor 1 introduces the low-pressure refrigerant into low-pressure space 12 from a refrigeration cycle circuit (not illustrated) provided outside of sealed vessel 10 via refrigerant suction tube 13. First, the high-pressure refrigerant compressed by compression mechanism 170 is introduced into high-pressure space 11. Then, the high-pressure refrigerant is ejected from high-pressure space 11 to the refrigeration cycle circuit via refrigerant ejection tube 14. Oil reservoir 15 that reserves lubricating oil is provided on the bottom of low-pressure space 12.

Compressor 1 includes fixed scroll 30 and orbiting scroll 40 in low-pressure space 12. Fixed scroll 30 is a non-orbiting scroll of the present disclosure. Fixed scroll 30 is disposed adjacent to the lower side of partition wall 20. Orbiting scroll 40 engages with the lower side of fixed scroll 30.

Fixed scroll 30 include fixed scroll end plate 31 having a disc shape, and fixed scroll lap 32 having a spiral shape and vertically provided on a lower face of fixed scroll end plate 31.

Orbiting scroll 40 includes orbiting scroll end plate 41 having a disc shape, orbiting scroll lap 42 having a spiral shape and vertically provided on an upper face of orbiting scroll end plate 41, and lower boss 43. Lower boss 43 is a tubular protrusion provided at a substantially center of a lower face of orbiting scroll end plate 41.

Fixed scroll end plate 31 is a first end plate of the present disclosure, and fixed scroll lap 32 is a first scroll body of the present disclosure. Orbiting scroll end plate 41 is a second end plate of the present disclosure, and orbiting scroll lap 42 is a second scroll body of the present disclosure.

Orbiting scroll lap 42 of orbiting scroll 40 engages with fixed scroll lap 32 of fixed scroll 30 to form compression chamber 50 between orbiting scroll 40 and fixed scroll 30. Compression chamber 50 is provided on a side of an inner wall (described later) and on a side of an outer wall (described later) of orbiting scroll lap 42.

Main bearing 60 that supports orbiting scroll 40 is provided below fixed scroll 30 and orbiting scroll 40. Main bearing 60 includes boss storage part 62 provided at a substantially center of an upper face of main bearing 60, and bearing part 61 provided below boss storage part 62. Boss storage part 62 is a recess for storing lower boss 43. Bearing part 61 is provided with a through hole having an upper end opened to boss storage part 62 and a lower end opened to low-pressure space 12.

Main bearing 60 supports orbiting scroll 40 with the upper face of main bearing 60, and axially supports rotational shaft 70 with bearing part 61.

Rotational shaft 70 is a shaft having a longitudinal direction that is a vertical direction in FIG. 1. Rotational shaft 70 has one end axially supported by bearing part 61, and the other end axially supported by sub bearing 16. Sub bearing 16 is provided below low-pressure space 12, desirably, in oil reservoir 15. Eccentric shaft 71 that is eccentric relative to a center of rotational shaft 70 is provided at an upper end of rotational shaft 70. Eccentric shaft 71 is slidably inserted into lower boss 43 via swing bush 78 and orbiting bearing 79. Lower boss 43 is orbited by eccentric shaft 71.

Oil path 72 that passes lubricating oil therethrough is provided in rotational shaft 70. Oil path 72 is a through hole formed in an axial direction of rotational shaft 70. One end of oil path 72 is suction opening 73 provided at a lower end of rotational shaft 70, and opened into oil reservoir 15. Paddle 74 that pumps up the lubricating oil from suction opening 73 to oil path 72 is provided above suction opening 73.

First branch oil path 751 and second branch oil path 761 are provided within rotational shaft 70. First branch oil path 751 has one end that is first oil feeding opening 75 opened to a bearing face of bearing part 61, and the other end communicating with oil path 72. Second branch oil path 761 has one end that is second oil feeding opening 76 opened to a bearing face of sub bearing 16, and the other end communicating with oil path 72.

An upper end of oil path 72 is third oil feeding opening 77 opened to the inside of boss storage part 62.

Rotational shaft 70 is coupled to motor 80. Motor 80 is disposed between main bearing 60 and sub bearing 16. Motor 80 is a single-phase AC motor driven with single-phase AC power. Motor 80 includes stator 81 fixed to sealed vessel 10 and rotor 82 disposed on an inner side of stator 81.

Rotational shaft 70 is fixed to rotor 82. Rotational shaft 70 includes balance weight 17*a* provided above rotor 82 and balance weight 17*b* provided below rotor 82. Balance weight 17*a* and balance weight 17*b* are shifted from each other by 180 degrees in a circumferential direction of rotational shaft 70.

Rotational shaft 70 rotates while keeping in balance with a centrifugal force of balance weight 17*a* and balance weight 17*b*, and a centrifugal force generated by the revolution of orbiting scroll 40. Balance weight 17*a* and balance weight 17*b* may be provided on rotor 82.

Anti-rotation member (Oldham ring) 90 is provided between orbiting scroll 40 and main bearing 60. Oldham ring 90 prevents the rotation of orbiting scroll 40. Thereby, orbiting scroll 40 orbits without rotating with respect to fixed scroll 30.

Fixed scroll 30, orbiting scroll 40, motor 80, Oldham ring 90, and main bearing 60 are disposed in low-pressure space 12. Fixed scroll 30 and orbiting scroll 40 are disposed between partition wall 20 and main bearing 60.

Compression mechanism 170 including at least fixed scroll 30, orbiting scroll 40, main bearing 60, and Oldham ring 90 is provided with elastic body 160.

Specifically, elastic body 160 biases fixed scroll 30 and main bearing 60, and serves to separate fixed scroll 30 from orbiting scroll 40.

Partition wall 20 and main bearing 60 are fixed to sealed vessel 10. Fixed scroll 30 is axially movable at least partially between partition wall 20 and main bearing 60, in particular, between fixed scroll 30 and main bearing 60.

More specifically, fixed scroll 30 is axially (vertically in FIG. 1) movable with respect to columnar members 100 provided on main bearing 60. Columnar members 100 each have a lower end inserted into and fixed to bearing-side hole 102 (see FIG. 5 described later), and an upper end slidably inserted into scroll-side hole 101 (see FIGS. 3 and 4 described later).

Columnar members 100 restrict rotation and radial motion of fixed scroll 30, and allow axial motion of fixed scroll 30. That is, fixed scroll 30 is supported to main bearing 60 by columnar members 100, and can axially move partially between partition wall 20 and main bearing 60, in particular, between partition wall 20 and orbiting scroll 40.

Operations and actions of compressor 1 will be described below. Driving motor 80 rotates rotational shaft 70 along with rotor 82. Due to the existence of eccentric shaft 71 and Oldham ring 90, orbiting scroll 40 orbits around a central axis of rotational shaft 70 without rotating. This reduces a capacity of compression chamber 50 and compresses the refrigerant in compression chamber 50.

The refrigerant is introduced from refrigerant suction tube 13 into low-pressure space 12. The refrigerant in low-pressure space 12 is guided from an outer circumference of orbiting scroll 40 into compression chamber 50. The refrigerant compressed in compression chamber 50 is ejected from refrigerant ejection tube 14 via high-pressure space 11.

Due to the rotation of rotational shaft 70, the lubricating oil reserved in oil reservoir 15 is pumped up from suction opening 73 to an upper portion of oil path 72 along paddle 74. The pumped lubricating oil is supplied from first oil feeding opening 75, second oil feeding opening 76, and third oil feeding opening 77 to bearing part 61, sub bearing 16, and boss storage part 62. Further, the lubricating oil pumped up to boss storage part 62 is guided to sliding faces of main bearing 60 and orbiting scroll 40, discharged through return path 63 (see FIG. 5 described later), and returns to oil reservoir 15 again.

Figure 2A:
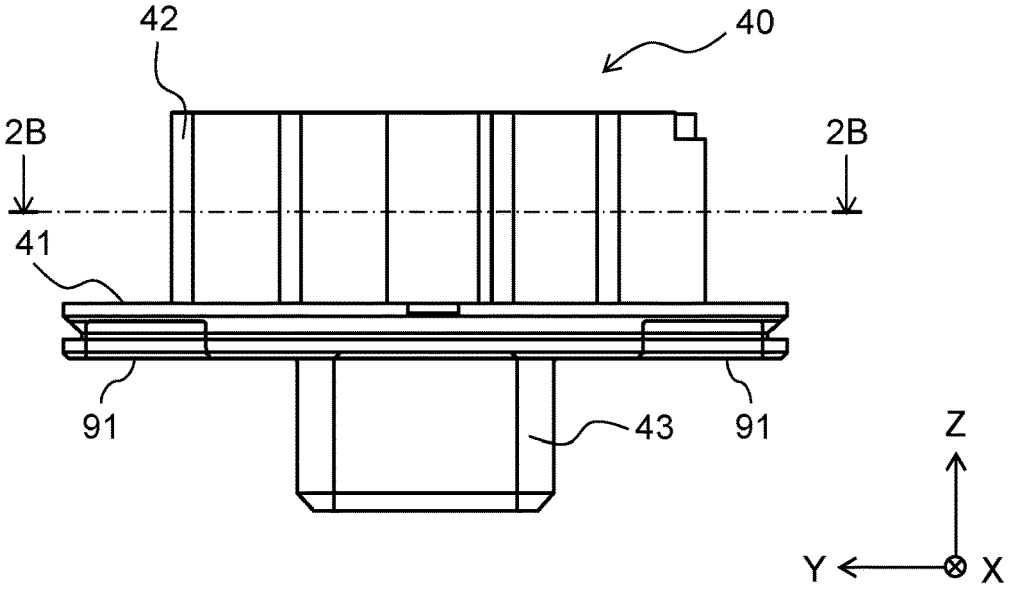
FIG. 2A is a side view of an orbiting scroll of the scroll compressor.
Figure 2B:
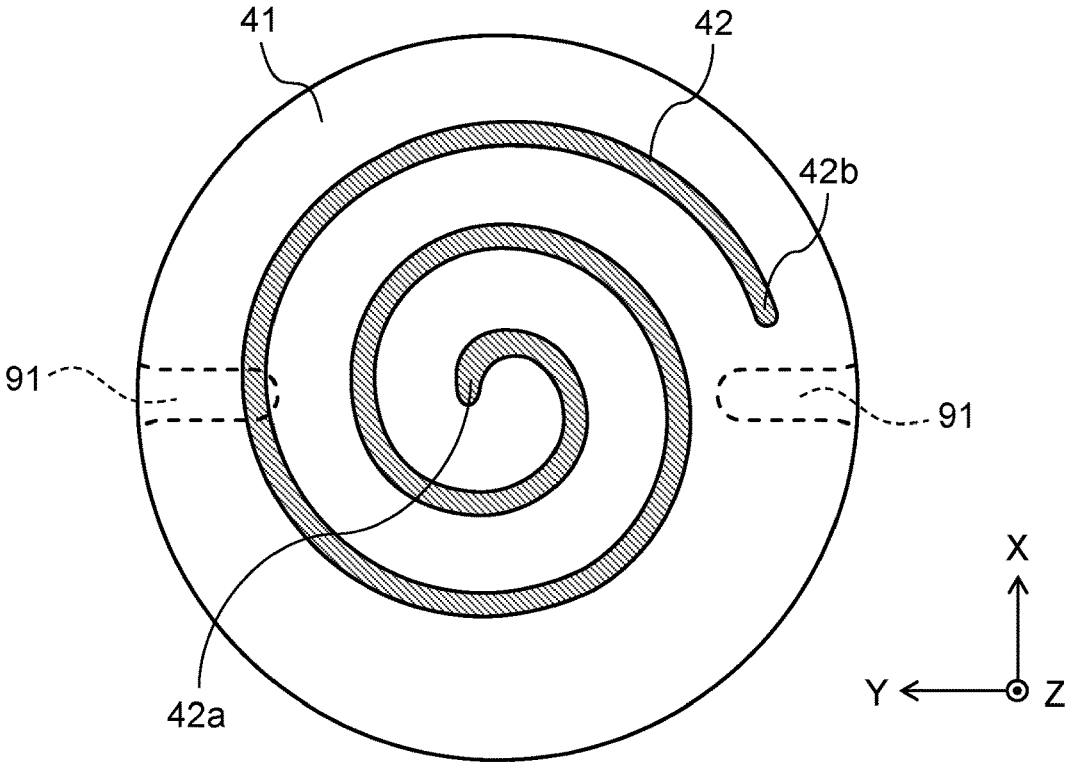
FIG. 2B is a sectional view taken along line 2B-2B in FIG. 2A.

Detailed configuration of compressor 1 will be further described below. FIG. 2A is a side view of the orbiting scroll of the scroll compressor according the present exemplary embodiment. FIG. 2B is a sectional view taken along line 2B-2B in FIG. 2A.

Orbiting scroll lap 42 is a wall having an involute curved cross-section, and gradually increases in radius from start end 42*a* located at a central side of orbiting scroll end plate 41 toward terminal end 42*b* located on an outer circumferential side. Orbiting scroll lap 42 has a predetermined height (vertical length) and a predetermined wall thickness (radial length of orbiting scroll lap 42).

A pair of first key grooves 91 having a longitudinal direction from the outer circumferential side toward the central side are provided at both ends of a lower face of orbiting scroll end plate 41.

Figure 3:
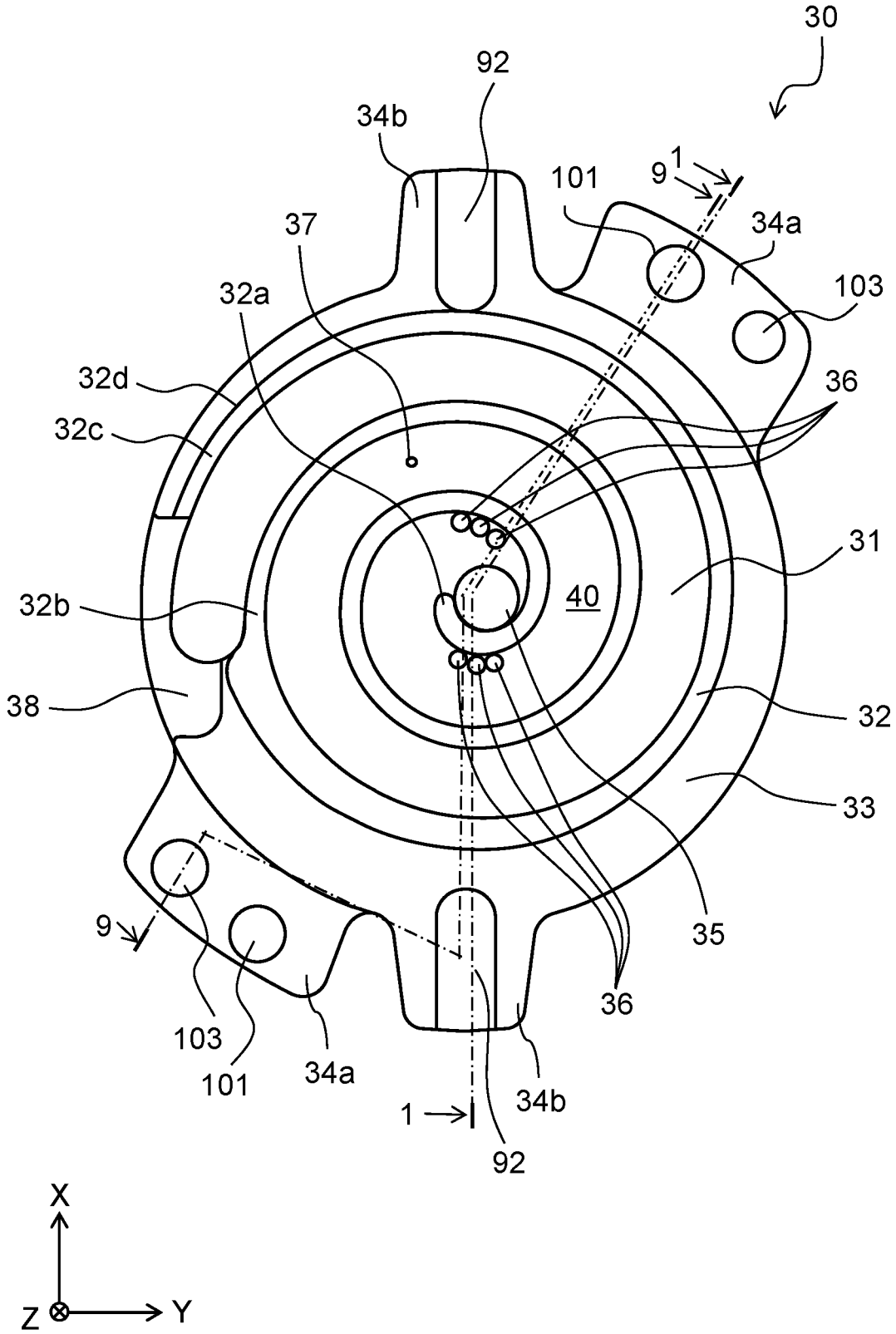
FIG. 3 is a bottom view of a fixed scroll of the scroll compressor.
Figure 4:
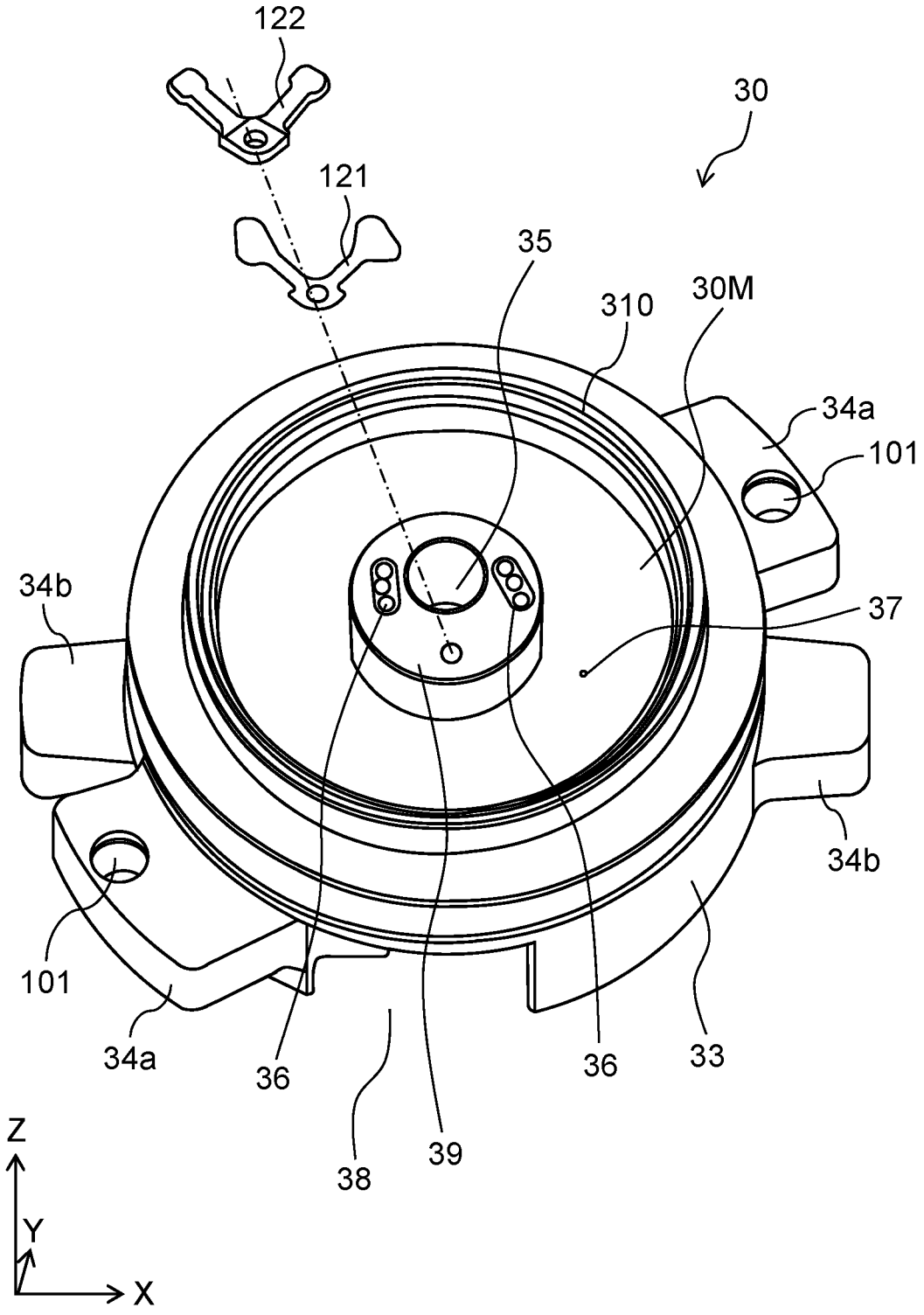
FIG. 4 is an exploded perspective view of the fixed scroll of the scroll compressor when viewed from above.

FIG. 3 is a bottom view of the fixed scroll of the scroll compressor according to the present exemplary embodiment. FIG. 4 is an exploded perspective view of the fixed scroll when viewed from above.

As illustrated in FIGS. 3 and 4, fixed scroll lap 32 is a wall having an involute curved cross-section, and gradually increases in radius from start end 32*a* located at a center side of fixed scroll end plate 31 toward terminal end 32*c* located on the outer circumferential side. Fixed scroll lap 32 includes the same predetermined height (vertical length) and predetermined wall thickness (radial length of fixed scroll lap 32) as those of orbiting scroll lap 42.

Fixed scroll lap 32 includes an inner wall (wall face on the central side) and an outer wall (wall face on the outer circumferential side) from start end 32*a* to intermediate part 32*b*, and includes only the inner wall from intermediate part 32*b* to terminal end 32*c*.

First ejection port 35 is provided at a substantially center of fixed scroll end plate 31. Bypass port 36 and intermediate-pressure port 37 are provided in fixed scroll end plate 31. Bypass ports 36 are disposed in a region where the high-pressure refrigerant acquired immediately before completion of compression is present, in a vicinity of first ejection port 35. Bypass ports 36 are a set of three small holes. Bypass ports 36 include two sets of bypass ports communicating with compression chamber 50 formed on the outer wall side of orbiting scroll lap 42, and bypass ports communicating with compression chamber 50 formed on the inner wall side of orbiting scroll lap 42. Intermediate-pressure port 37 is disposed in a region where the intermediate-pressure refrigerant acquired in the middle of compression is present, in a vicinity of intermediate part 32*b*.

Outer circumferential parts of fixed scroll 30 have a pair of first flanges 34*a* and a pair of second flanges 34*b* that protrude from circumferential wall 33 toward the outer circumferential side. First flanges 34*a* and second flanges 34*b* are provided lower than fixed scroll end plate 31 (closer to orbiting scroll 40). Second flanges 34*b* are provided below first flanges 34*a*, and their lower faces (faces on the side of orbiting scroll 40) are substantially flush with a front end face of fixed scroll lap 32.

The pair of first flanges 34*a* are disposed substantially regularly at a predetermined interval in the circumferential direction of rotational shaft 70. The pair of second flanges 34*b* are disposed substantially regularly at a predetermined interval in the circumferential direction of rotational shaft 70.

Circumferential wall 33 of fixed scroll 30 has suction part 38 for taking the refrigerant into compression chamber 50.

First flanges 34*a* each have scroll-side hole 101 into which an outer end of columnar member 100 is inserted. The pair of first flanges 34*a* each have one scroll-side hole 101. Scroll-side holes 101 are reception parts of the present disclosure. Two scroll-side holes 101 are disposed at a predetermined interval in the circumferential direction. Desirably, two scroll-side holes 101 are regularly disposed at intervals of 180 degrees in the circumferential direction.

Thus, columnar members 100 include a pair of two columnar members 100 disposed at a regular interval of 180 degrees in the circumferential direction, or two pairs of two columnar members 100 disposed at a regular interval of 180 degrees in the circumferential direction. Scroll-side holes 101 are not necessarily through holes, and may be recesses dented from the lower face side.

Scroll-side holes 101 communicate with the outside of fixed scroll 30, that is, low-pressure space 12 via through holes (not illustrated).

Second flanges 34*b* have respective second key grooves 92. A pair of second key grooves 92 are formed in respective second flanges 34*b*, and each have the longitudinal direction extending from the outer circumference toward the center.

Scroll-side recess 103, in which an outer end of elastic body 160 is disposed, is separated from scroll-side hole 101, and is provided in a vicinity of scroll-side hole 101. In other words, scroll-side recess 103 is provided in the vicinity of scroll-side hole 101 in the circumferential direction. Two scroll-side recesses 103 are disposed at a predetermined interval in the circumferential direction. Desirably, two scroll-side recesses 103 are disposed at a regular interval of 180 degrees in the circumferential direction.

Elastic bodies 160 include a pair of two elastic bodies disposed at an interval of 180 degrees in the circumferential direction, or two pairs of two elastic bodies disposed at an interval of 180 degrees in the circumferential direction.

Scroll-side holes 101 making a pair and scroll-side recesses 103 making a pair are disposed at a regular pitch. The "regular pitch" described herein includes "substantially regular pitch". The pair of scroll-side holes 101 and the pair of scroll-side recesses 103 are concentrically disposed.

This can reduce the radial length of first flanges 34*a* of fixed scroll 30 and in turn, the weight of fixed scroll 30, to achieve cost reduction. Further, setting an angle between scroll-side holes 101 and scroll-side recesses 103 about the center of fixed scroll 30 to about 15 degrees can reduce the circumferential length of first flanges 34*a* of fixed scroll 30 and in turn, the weight of fixed scroll 30, to achieve cost reduction.

As illustrated in FIG. 4, upper boss 39 is provided at the center of the upper face (face on the side of partition wall 20) of fixed scroll 30. Upper boss 39 is a tubular protrusion that protrudes from the upper face of fixed scroll 30. First ejection port 35 and bypass ports 36 are opened to an upper face of upper boss 39. The upper face of upper boss 39 and partition wall 20 form ejection space 30H therebetween (see FIG. 7 described later). First ejection port 35 and bypass ports 36 communicate with ejection space 30H.

The upper face of fixed scroll 30 has ring-shaped projection 310 on the outer circumferential side of upper boss 39. Upper boss 39 and ring-shaped projection 310 form a recess on the upper face of fixed scroll 30. The recess forms intermediate-pressure space 30M (see FIG. 7 described later). Intermediate-pressure port 37 is opened to the upper face (bottom face of the recess) of fixed scroll 30, and communicates with intermediate-pressure space 30M.

A diameter of intermediate-pressure port 37 is smaller than a wall thickness of orbiting scroll lap 42. This can prevent communication of compression chamber 50 formed on the inner wall side of orbiting scroll lap 42 with compression chamber 50 formed on the outer wall side of orbiting scroll lap 42.

The upper face of upper boss 39 has bypass check valve 121 that can open/close bypass ports 36 and bypass check valve stop 122 that prevents excessive deformation of bypass check valve 121. A lead valve may be used as bypass check valve 121 to make it compact in height. Further, a V-shaped lead valve may be used as bypass check valve 121 to open/close bypass ports 36 communicating with compression chamber 50 formed on the outer wall side of orbiting scroll lap 42 and bypass ports 36 communicating with compression chamber 50 formed on the inner wall side of orbiting scroll lap 42 by means of one lead valve.

The upper face (bottom face of the recess) of fixed scroll 30 has an intermediate-pressure check valve (not illustrated) that can open/close intermediate-pressure port 37 and an intermediate-pressure check valve stop (not illustrated) that prevents excessive deformation of the intermediate-pressure check valve. A lead valve may be used as the intermediate-pressure check valve to make it compact in height. The intermediate-pressure check valve may include a ball valve and a spring.

Figure 5:
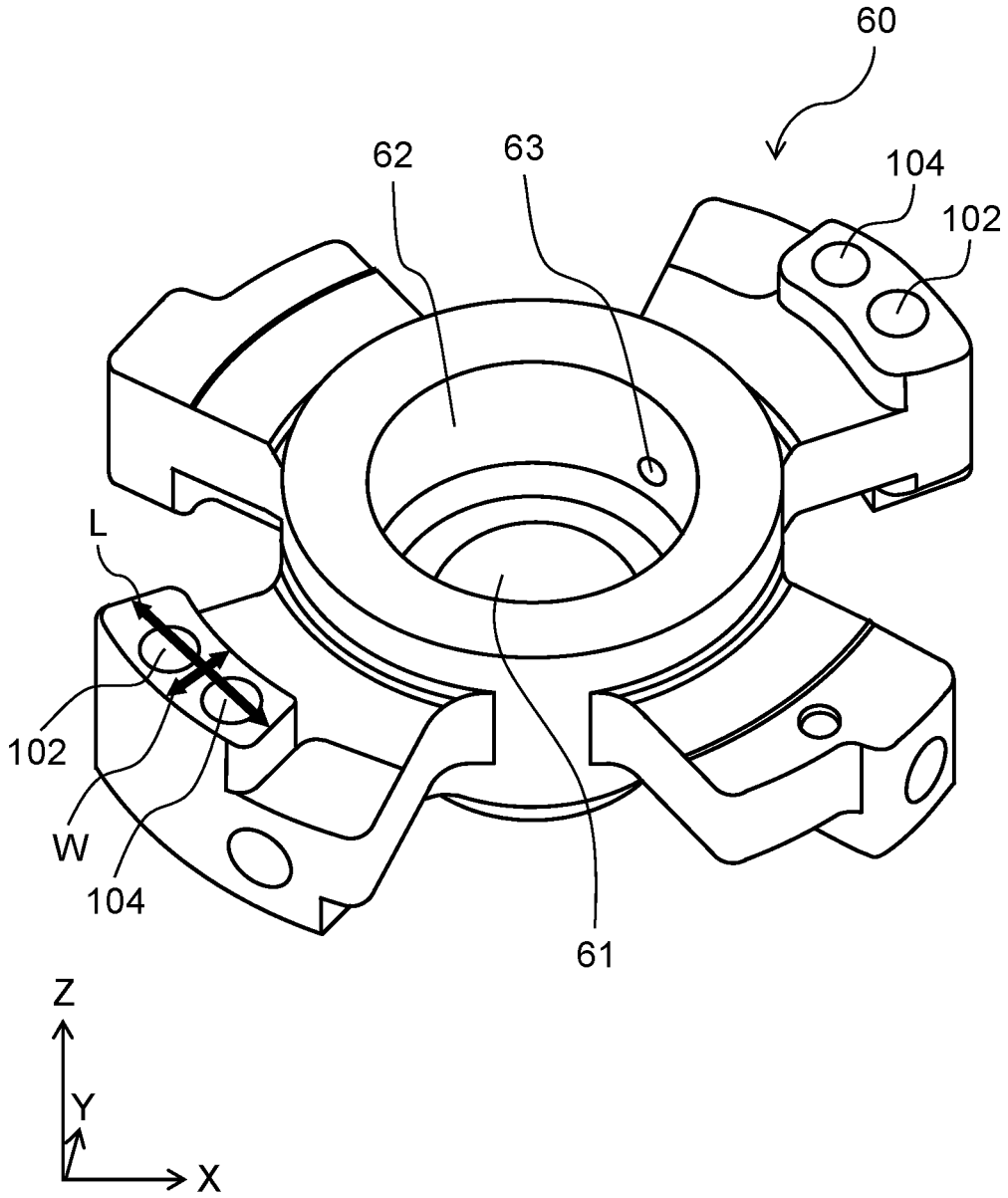
FIG. 5 is a perspective view of a main bearing of the scroll compressor when viewed from above.

FIG. 5 is a perspective view of the main bearing of the scroll compressor according the present exemplary embodiment when viewed from above.

An outer circumferential part of main bearing 60 has bearing-side holes 102 into which lower ends of respective columnar members 100 are inserted. Two bearing-side holes 102 are disposed at a predetermined interval in the circumferential direction. Desirably, two bearing-side holes 102 are disposed at a regular interval of 180 degrees in the circumferential direction. Bearing-side holes 102 are not necessarily through holes, and may be recesses dented from the upper face side.

Bearing-side recess 104, in which a lower end of elastic body 160 is disposed, is separate from bearing-side hole 102, and is disposed in a vicinity of bearing-side hole 102. In other words, bearing-side recess 104 is provided in the vicinity of bearing-side hole 102 in the circumferential direction. A plurality of bearing-side recesses 104 are disposed at a predetermined interval in the circumferential direction. Desirably, bearing-side recesses 104 are provided such that elastic bodies 160 include a pair of two elastic bodies 160 disposed at an interval of 180 degrees in the circumferential direction, or two pairs of two elastic bodies 160 disposed at an interval of 180 degrees in the circumferential direction.

Bearing-side holes 102 making a pair and bearing-side recesses 104 making a pair are disposed at a regular pitch. The "regular pitch" includes "substantially regular pitch". The pair of bearing-side holes 102 and the pair of bearing-side recesses 104 are concentrically disposed.

This can reduce a radial length W of the outer circumferential parts of main bearing 60 around bearing-side holes 102 and bearing-side recesses 104 and in turn, the weight of main bearing 60, to achieve cost reduction. The outer circumferential parts of main bearing 60 around bearing-side holes 102 and bearing-side recesses 104 can be formed to keep its casting surface without machining, thereby reducing machining costs.

In addition, setting an angle between bearing-side hole 102 and bearing-side recess 104 about the center of main bearing 60 to 15 degrees can reduce a circumferential length L of main bearing 60 around bearing-side holes 102 and bearing-side recesses 104 and in turn, the weight of main bearing 60, to achieve cost reduction.

That is, the configuration in which elastic body 160 is disposed in scroll-side recess 103 of fixed scroll 30 and bearing-side recess 104 of main bearing 60 facilitates positioning of elastic body 160. This can improve an assembling operation. For example, a depth of scroll-side recess 103 or bearing-side recess 104 may be set to one fifth of a free height of elastic body 160 or more, to improve the stability of installed elastic body 160, further improving the assembling operation.

Main bearing 60 has return paths 63 each having one end opened to boss storage part 62, and the other end opened to a lower face of main bearing 60. The one end of return path 63 may be opened to an upper face of main bearing 60. The other end of return path 63 may be opened to a side face of main bearing 60.

Return path 63 also communicates with bearing-side hole 102. Accordingly, lubricating oil is supplied to bearing-side hole 102 through return path 63.

As described above, according the present exemplary embodiment, elastic body 160 is disposed between columnar members 100 in the circumferential direction. More specifically, columnar member 100 and elastic body 160 are alternately disposed along the circumferential direction.

Further, in the above-mentioned exemplary embodiment, two columnar members 100 and two elastic bodies 160 are disposed. However, the present disclosure is not limited to this. That is, one elastic body 160 may be disposed, or four columnar members 100 may be disposed.

In the configuration in which the plurality of elastic bodies 160 and the plurality of columnar members 100 are disposed, it is preferred to dispose columnar members 100 at a regular first interval in the circumferential direction, and dispose elastic bodies 160 at a regular second interval in the circumferential direction. More preferably, the first interval is equal to the second interval. Equal described herein includes substantially equal.

Figure 6:
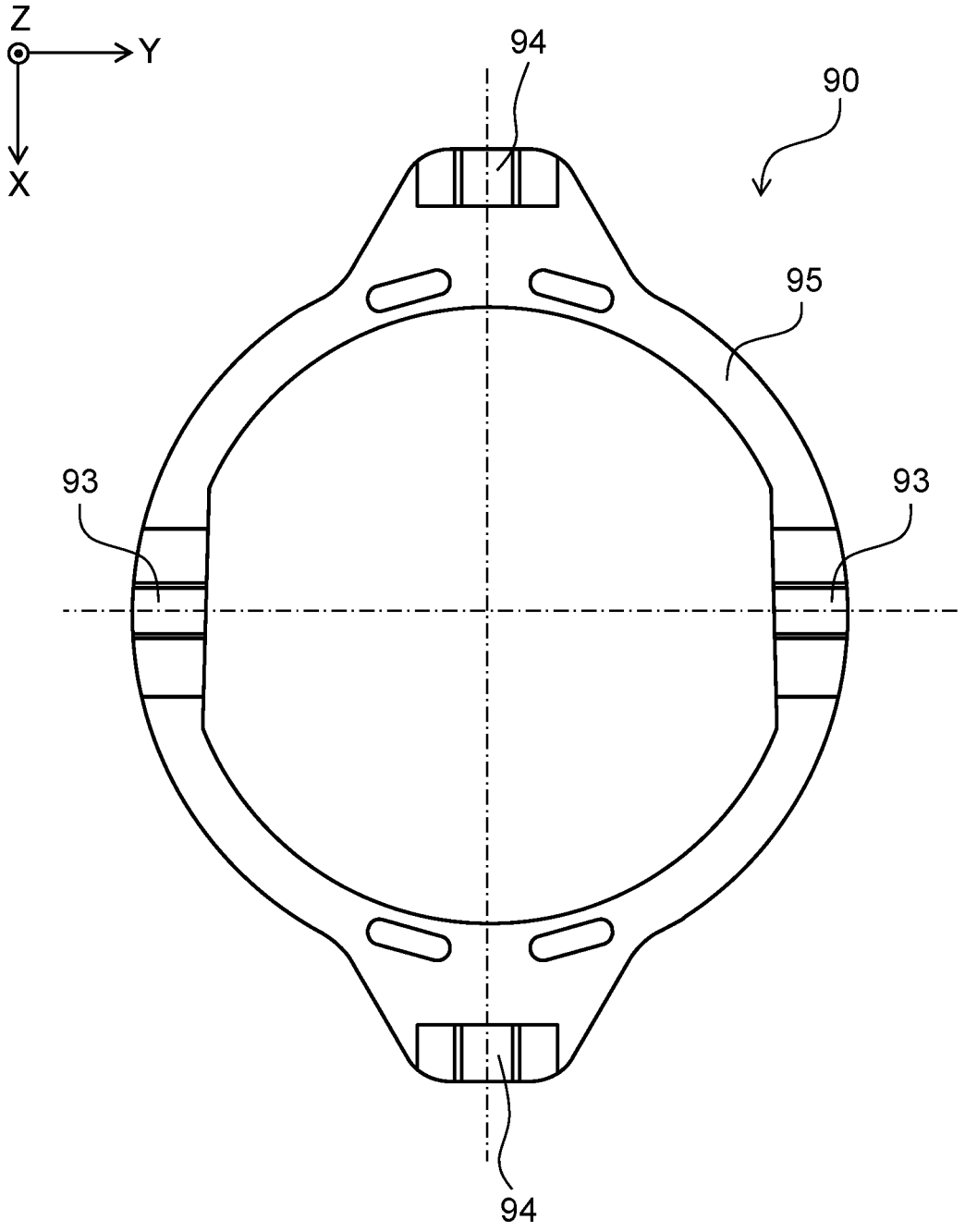
FIG. 6 is a top view of an Oldham ring of the scroll compressor.

FIG. 6 is a top view of an Oldham ring of the scroll compressor according to the present exemplary embodiment.

Oldham ring 90 includes ring-shaped part 95 having a substantially annular shape, and a pair of first keys 93 and a pair of second keys 94 that protrude from an upper face of ring-shaped part 95. First keys 93 and second keys 94 are provided such that a straight line connecting two first keys 93 to each other is orthogonal to a straight line connecting two second keys 94 to each other.

First keys 93 engage with respective first key grooves 91 in orbiting scroll 40, and second keys 94 engage with respective second key grooves 92 in fixed scroll 30. This enables orbiting scroll 40 to orbit with respect to fixed scroll 30 without rotating.

In the present exemplary embodiment, fixed scroll 30, orbiting scroll 40, and Oldham ring 90 are disposed in this order from above in the axial direction of rotational shaft 70. Thus, first keys 93 and second keys 94 are formed on a same plane of ring-shaped part 95. Thus, at manufacturing of Oldham ring 90, first keys 93 and second keys 94 can be processed in the same direction, to reduce the number of times Oldham ring 90 is detached from a machining device. This can improve the machining accuracy of Oldham ring 90 and reduce machining costs of Oldham ring 90.

Figure 7:
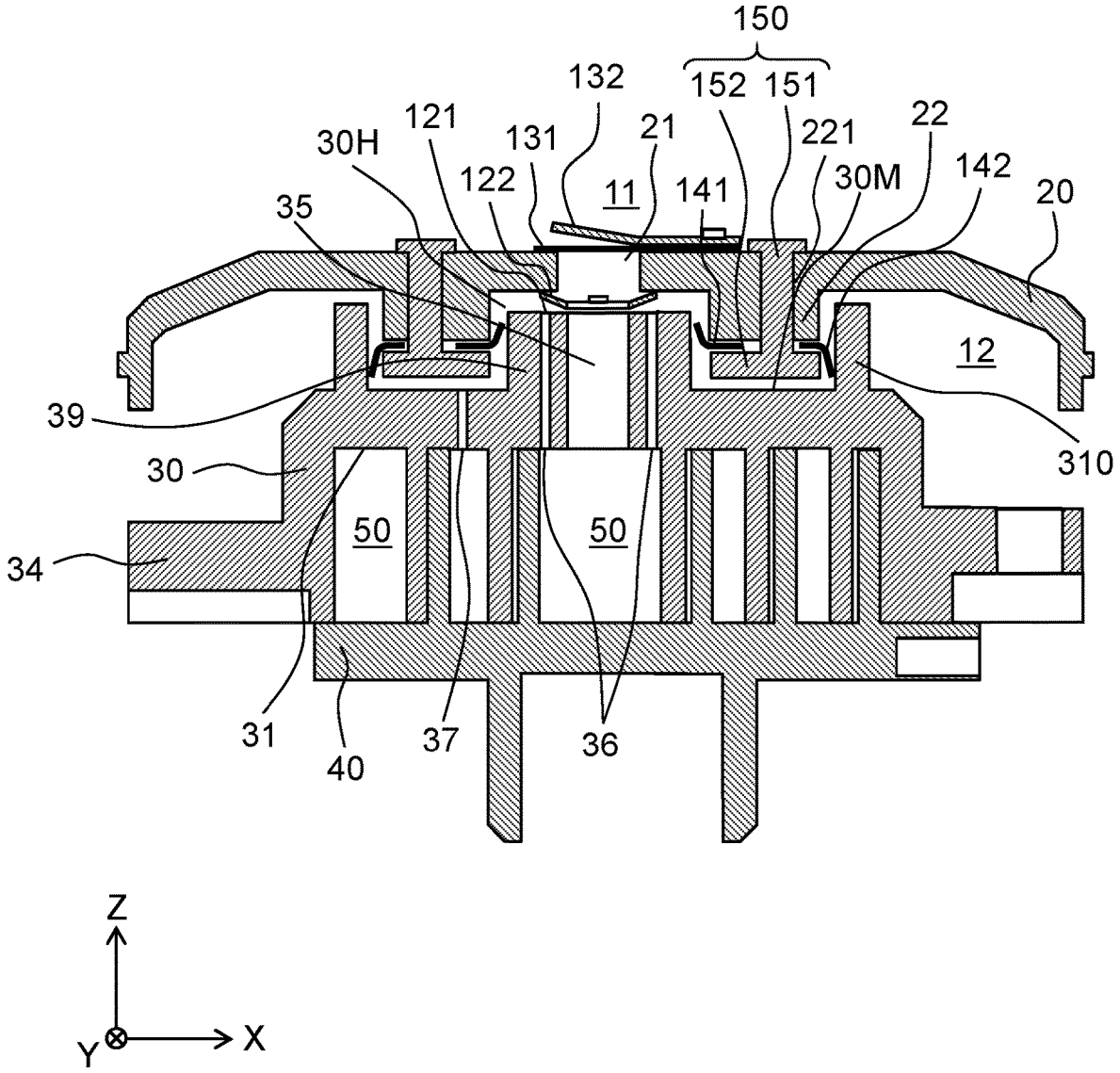
FIG. 7 is a sectional view of a main part of the scroll compressor.
Figure 8:
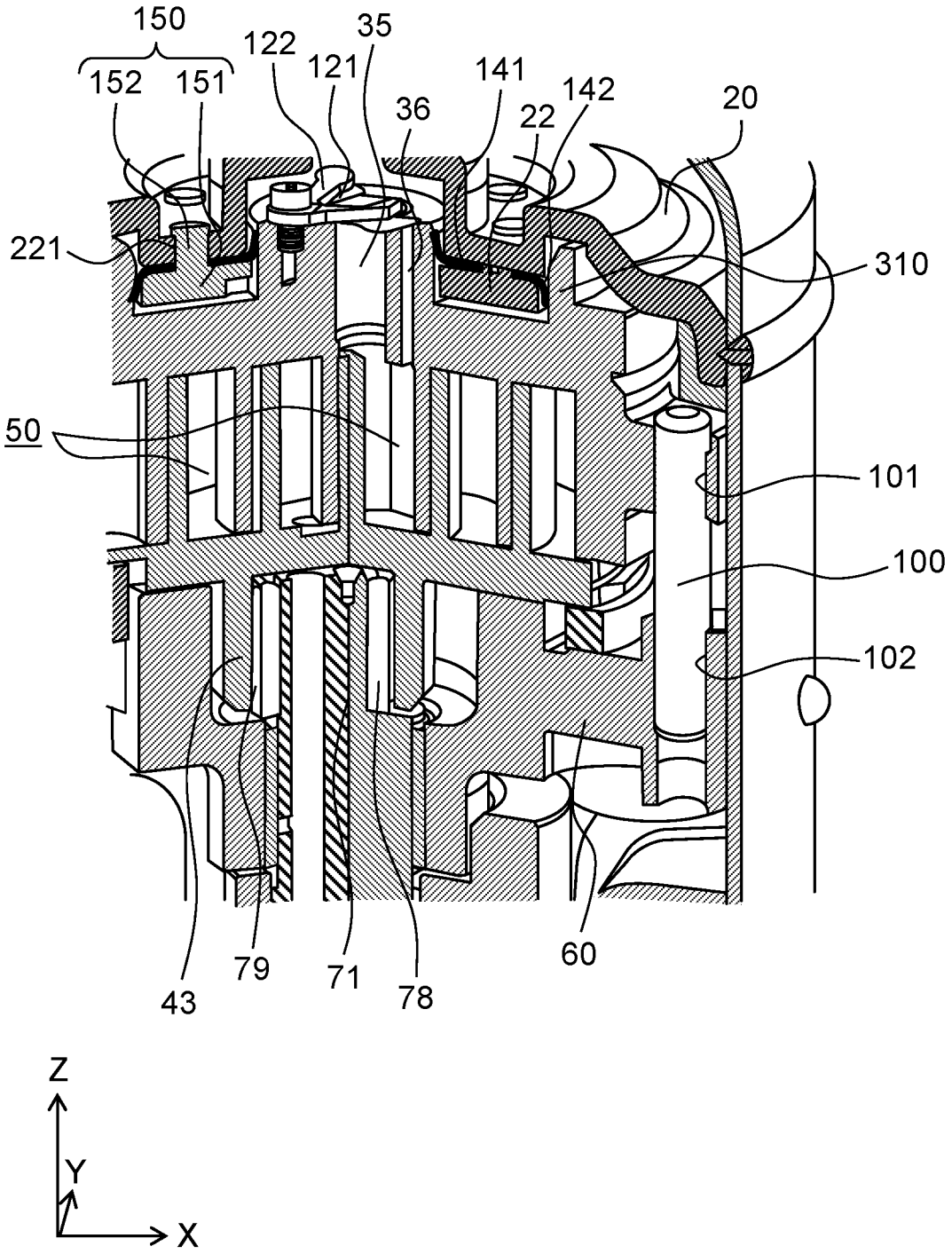
FIG. 8 is a sectional perspective view of the main part of the scroll compressor.

FIG. 7 is a sectional view of a main part of the scroll compressor according to the present exemplary embodiment. FIG. 8 is a sectional perspective view of the main part of the sealed scroll compressor according to the present exemplary embodiment.

Second ejection port 21 is provided at a center of partition wall 20. An upper face of partition wall 20 has ejection check valve 131 that can open/close second ejection port 21, and ejection check valve stop 132 that prevents excessive deformation of ejection check valve 131.

Ejection space 30H is formed between partition wall 20 and fixed scroll 30. Ejection space 30H communicates with compression chamber 50 via first ejection port 35 and bypass ports 36, and communicates with high-pressure space 11 via second ejection port 21.

Since ejection space 30H communicates with high-pressure space 11 through second ejection port 21, a back pressure is applied to the upper face of fixed scroll 30. That is, a high pressure is applied to ejection space 30H, pressing fixed scroll 30 onto orbiting scroll 40. This can eliminate a gap between fixed scroll 30 and orbiting scroll 40 to achieve the efficient operation of compressor 1.

Further, in addition to first ejection port 35, bypass ports 36 that communicates compression chamber 50 with ejection space 30H, and bypass check valve 121 on bypass ports 36 are provided. For this reason, when compression chamber 50 reaches a predetermined pressure, the refrigerant can be guided from compression chamber 50 into ejection space 30H while preventing a back flow of the refrigerant from ejection space 30H. As a result, excessive compression of the refrigerant in compression chamber 50 can be suppressed to achieve the efficient operation of compressor 1 in a wide operational range.

Ejection check valve 131 has a larger thickness than bypass check valve 121. This can prevent ejection check valve 131 from opening before bypass check valve 121 opens.

Second ejection port 21 has a larger capacity than first ejection port 35. This can reduce a pressure loss of the refrigerant ejected from compression chamber 50.

A taper may be formed at an inflow side of second ejection port 21. This can further reduce the pressure loss.

The lower face of partition wall 20 has protrusion 22 which annularly protrudes around second ejection port 21. Protrusion 22 has a plurality of holes 221 into which a portion of blocking member 150 (described later) is inserted.

Protrusion 22 is provided with first seal member 141 and second seal member 142. First seal member 141 is a ring-shaped seal member that protrudes from protrusion 22 toward the central side of partition wall 20. A tip of first seal member 141 abuts a side face of upper boss 39. That is, first seal member 141 is disposed in a gap located between partition wall 20 and fixed scroll 30, and on an outer circumference of ejection space 30H.

Second seal member 142 is a ring-shaped seal member that protrudes from protrusion 22 toward the outer circumferential side of partition wall 20. Second seal member 142 is disposed outside first seal member 141. A tip of second seal member 142 abuts an inner side face of ring-shaped projection 310. That is, second seal member 142 is disposed in a gap located between partition wall 20 and fixed scroll 30, and on an outer circumference of intermediate-pressure space 30M.

In other words, ejection space 30H and intermediate-pressure space 30M are formed between partition wall 20 and fixed scroll 30 using first seal member 141 and second seal member 142. Ejection space 30H is a space formed on the upper face side of upper boss 39, and intermediate-pressure space 30M is a space formed on the outer circumferential side of upper boss 39.

First seal member 141 is a seal member that divides ejection space 30H from intermediate-pressure space 30M, and second seal member 142 is a seal member that divides intermediate-pressure space 30M from low-pressure space 12.

For example, polytetrafluoroethylene that is a fluororesin is suitable for a material for first seal member 141 and second seal member 142 in terms of sealing and assembling performances. A fiber material may be mixed with the fluororesin to increase the reliability of the sealing performance of first seal member 141 and second seal member 142.

First seal member 141 and second seal member 142 are sandwiched between blocking member 150 and protrusion 22. Thus, after first seal member 141, second seal member 142, and blocking member 150 are assembled to partition wall 20, the constituents can be disposed in sealed vessel 10. This can reduce the number of components, and facilitate the assembling of the scroll compressor.

Describing in more detail, blocking member 150 includes ring-shaped part 151 disposed so as to be opposed to protrusion 22 of partition wall 20, and a plurality of protrusions 152 that protrude from one face of ring-shaped part 151.

An outer circumferential side of first seal member 141 is sandwiched between an inner circumferential side of an upper face of ring-shaped part 151 and a lower face of protrusion 22. An inner circumferential side of second seal member 142 is sandwiched between the outer circumferential side of the upper face of ring-shaped part 151 and the lower face of protrusion 22.

That is, ring-shaped part 151 is opposed to the lower face of protrusion 22 of partition wall 20 via first seal member 141 and second seal member 142.

A plurality of protrusions 152 are inserted into a plurality of respective holes 221 formed in protrusion 22. Upper ends of protrusions 152 are swaged such that ring-shaped part 151 is pressed onto the lower face of protrusion 22. That is, blocking member 150 is fixed to partition wall 20 such that upper ends of protrusions 152 are deformed in flat plate form, and ring-shaped part 151 is pressed onto the lower face of protrusion 22. Blocking member 150 may be made of aluminum to be readily swaged to partition wall 20.

In the state where first seal member 141 and second seal member 142 are attached to partition wall 20, an inner circumferential part of first seal member 141 protrudes from ring-shaped part 151 toward the central side of partition wall 20, and an outer circumferential part of second seal member 142 protrudes from ring-shaped part 151 toward the outer circumferential side of partition wall 20.

Partition wall 20, with first seal member 141 and second seal member 142 attached, is attached in sealed vessel 10, such that the inner circumferential part of first seal member 141 is pressed onto the outer circumferential face of upper boss 39 of fixed scroll 30. An outer circumferential part of second seal member 142 is pressed onto an inner circumferential face of ring-shaped projection 310 of fixed scroll 30.

Intermediate-pressure space 30M communicates with a region where the intermediate-pressure refrigerant acquired in the middle of compression in compression chamber 50 is present, via intermediate-pressure port 37. Thus, intermediate-pressure space 30M has a lower pressure than ejection space 30H, and a higher pressure than low-pressure space 12.

In this manner, in addition to ejection space 30H, intermediate-pressure space 30M is formed between partition wall 20 and fixed scroll 30 to facilitate the adjustment of the pressure of fixed scroll 30 onto orbiting scroll 40.

Since first seal member 141 and second seal member 142 form intermediate-pressure space 30M, a leakage of the refrigerant from ejection space 30H to intermediate-pressure space 30M, and from intermediate-pressure space 30M to low-pressure space 12 can be reduced.

Figure 9:
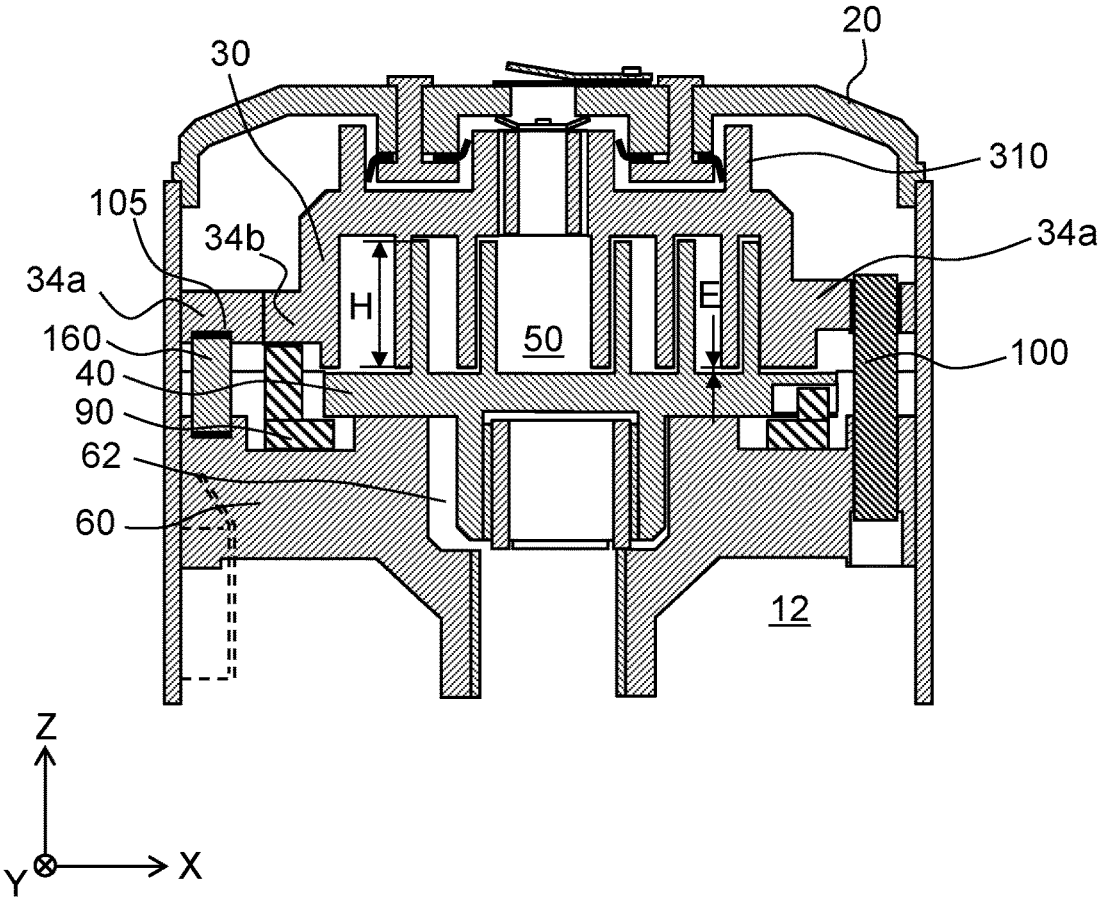
FIG. 9 is a sectional view taken along line 9-9 in FIG. 3.

FIG. 9 is a sectional view of a main part of the scroll compressor according to the present exemplary embodiment. As illustrated in FIG. 9, elastic body 160 is provided between a lower face of first flange 34*a* of fixed scroll 30 and the upper face of main bearing 60. Elastic body 160 biases fixed scroll 30 so as to be away from orbiting scroll 40 (upward in FIG. 9).

Figure 10:
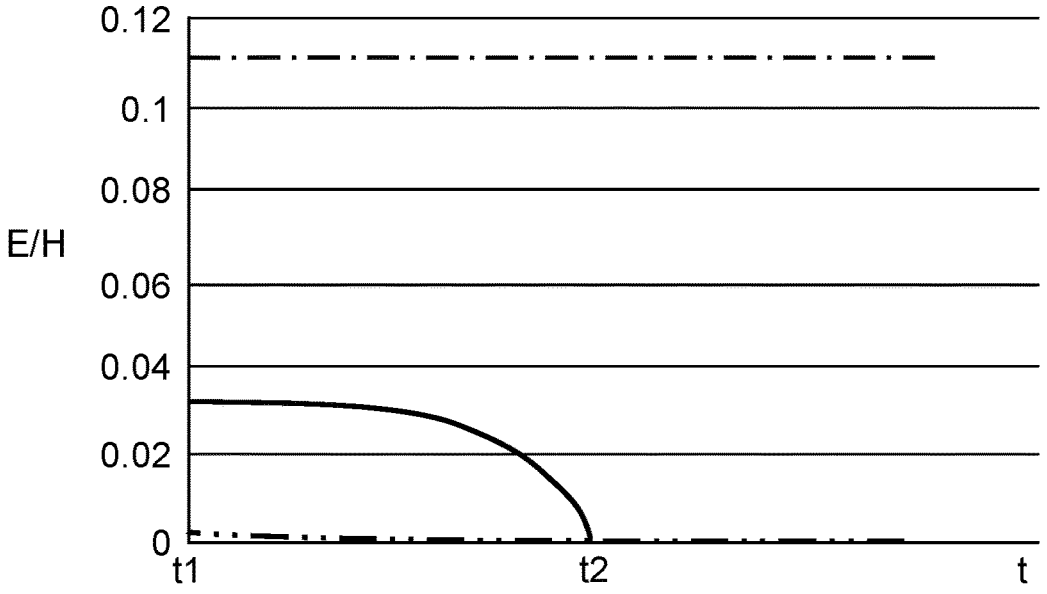
FIG. 10 is a view illustrating a change of ratio of a gap between a tip of fixed scroll lap and an orbiting scroll end plate to a height of the fixed scroll lap of the scroll compressor according the first exemplary embodiment with time.
Figure 11:
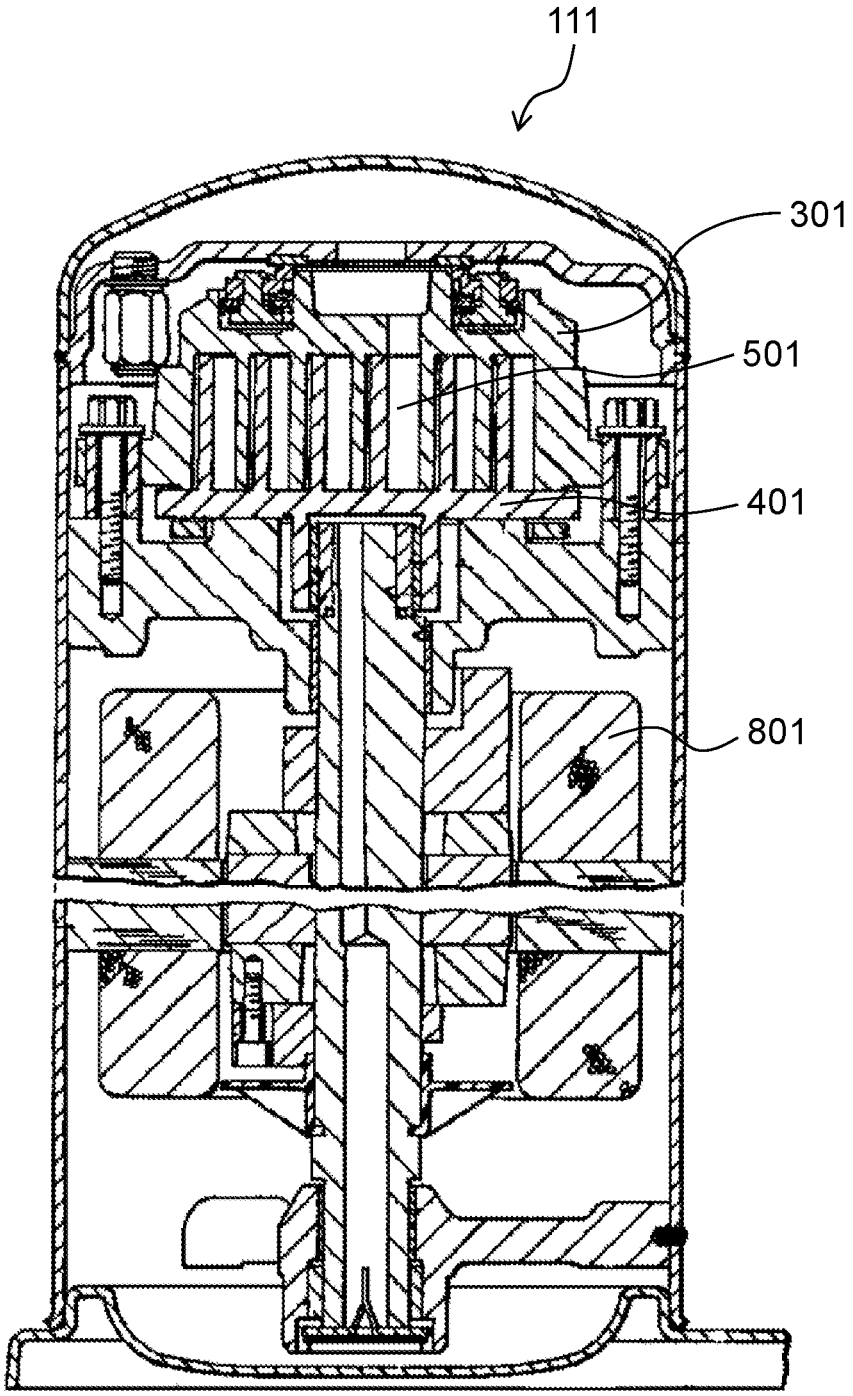
FIG. 11 is a longitudinal sectional view of a conventional scroll compressor.

In the present exemplary embodiment, during the stoppage of compressor 1, ratio E/H of gap E between a tip of fixed scroll lap 32 of fixed scroll 30 and an upper face of orbiting scroll end plate 41 of orbiting scroll 40 to height H of fixed scroll lap 32 of fixed scroll 30 is set to 0.03 (see FIG. 10).

During the stoppage of compressor 1, elastic body 160 brings at least a portion of fixed scroll 30, for example, a tip of ring-shaped projection 310 into contact with the lower face of partition wall 20.

According to the present exemplary embodiment, during the stoppage of compressor 1, due to a reactive force of elastic body 160, gaps are generated between the tip of fixed scroll lap 32 and orbiting scroll end plate 41, and between a tip of orbiting scroll lap 42 and fixed scroll end plate 31.

For this reason, immediately after the activation of compressor 1, complete compression in compression chamber 50 is not achieved to reduce a compression load. This can improve the startability of compressor 1. Specifically, even when a single-phase motor having a small starting torque is used as motor 80, compressor 1 can be readily started.

After the activation of compressor 1, the pressure of the refrigerant ejected from compression chamber 50 to ejection space 30H and high-pressure space 11 gradually increases. Then, when a force to press fixed scroll 30 onto orbiting scroll 40 becomes larger than the reactive force of elastic body 160, the gaps between the tip of fixed scroll lap 32 and orbiting scroll end plate 41 and between the tip of orbiting scroll lap 42 and fixed scroll end plate 31 are eliminated.

Thus, when a predetermined time elapses since the activation of compressor 1, complete compression in compression chamber 50 is achieved. For this reason, even when elastic body 160 is provided, the efficiency of compressor 1 does not lower.

In addition, the plurality of elastic bodies 160 can prevent fixed scroll 30 from unevenly separating from orbiting scroll 40 during the stoppage of compressor 1. This can ensure the gaps between the tip of fixed scroll lap 32 and orbiting scroll end plate 41 and between the tip of orbiting scroll lap 42 and fixed scroll end plate 31 reliably and stably. This can further improve the startability of compressor 1.

Flat plate 105 is disposed on an end face of elastic body 160. This can suppress an abnormal wear of contact faces of elastic body 160, and fixed scroll 30 and main bearing 60.

For example, flat plate 105 may be made of a steel material having a Vickers hardness (HV) of 200 or more to minimize the abnormal wear, thereby further improving the reliability.

Elastic bodies 160 are disposed at a predetermined interval in the circumferential direction. Desirably, the elastic bodies 160 are preferably disposed at a regular interval in the circumferential direction. Thus, over the whole circumference of fixed scroll 30, gaps between the tip of fixed scroll lap 32 and orbiting scroll end plate 41, and between the tip of orbiting scroll lap 42 and fixed scroll end plate 31 can be generated. This can further improve the startability of compressor 1.

Elastic bodies 160 may be disposed at a predetermined interval in the circumferential direction to distribute the reactive force of elastic bodies 160 and easily keep the axial force in balance. For this reason, during the operation of compressor 1, tumbling caused by elastic bodies 160, that is, the phenomenon that fixed scroll 30 is inclined relative to orbiting scroll 40 can be suppressed.

Elastic body 160 may be a flat spring. However, elastic body 160 is desirably, a coil spring. Generally, the coil spring has a lower spring constant than the flat spring. For this reason, when the length of the coil spring at installation of elastic body 160 varies due to a variation in assembling size of compression mechanism 170, a variation in the reactive force of elastic body 160 can be reduced. This can stably improve the startability.

Elastic body 160 may be formed of a metallic spring having a higher durability than a resin rubber spring, to improve the reliability.

During the stoppage of compressor 1, elastic bodies 160 bring at least a portion of fixed scroll 30 into contact with the lower face of partition wall 20.

This can limit gap E between the tip of fixed scroll lap 32 and the upper face of orbiting scroll end plate 41 as assembling dimension. Thus, variations in the gaps between the tip of fixed scroll lap 32 and orbiting scroll end plate 41, and between the tip of orbiting scroll lap 42 and fixed scroll end plate 31 can be reduced.

FIG. 10 is a view illustrating a change of ratio E/H of gap E between the tip of fixed scroll lap 32 and orbiting scroll end plate 41 to height H of the fixed scroll lap of the scroll compressor according the present exemplary embodiment with time. In FIG. 10, a horizontal axis represents elapsed time t from the activation of compressor 1, and a vertical axis represents ratio E/H.

In FIG. 10, a solid line represents a result of compressor 1 according the present exemplary embodiment in the case of ratio E/H of 0.03 during the stoppage of compressor 1. A dot and dash line and a two-dot chain line represent comparison examples in the cases of ratio E/H of 0.11 and 0.002, respectively, during the stoppage of compressor 1.

As illustrated in FIG. 10, when ratio E/H during the stoppage of compressor 1 is 0.03, appropriate gaps are generated between the tip of fixed scroll lap 32 and orbiting scroll end plate 41, and between the tip of orbiting scroll lap 42 and fixed scroll end plate 31. For this reason, immediately after the activation of compressor 1, complete compression in compression chamber 50 is not achieved. After the activation of compressor 1, as the pressure of the refrigerant ejected from compression chamber 50 to high-pressure space 11 increases, the gaps between the tip of fixed scroll lap 32 and orbiting scroll end plate 41, and between the tip of orbiting scroll lap 42 and fixed scroll end plate 31 decrease.

When the pressure in compression chamber 50 further increases and the force to press fixed scroll 30 onto orbiting scroll 40 becomes larger than the reactive force of elastic bodies 160 (after an elapse of predetermined time t2 from the activation of compressor 1), the gaps between the tip of fixed scroll lap 32 and orbiting scroll end plate 41, and between the tip of orbiting scroll lap 42 and fixed scroll end plate 31 are eliminated to achieve complete compression of compression chamber 50.

Thus, since compression chamber 50 has a low sealing performance and a low compression load until predetermined time t2 has elapsed after the activation of compressor 1, the starting torque of motor 80 can be reduced. On the contrary, after predetermined time t2 elapses, the sealing performance of compression chamber 50 increases to achieve efficient compression.

In the case where ratio E/H is equal to or larger than 0.1, in particular, ratio E/H is 0.11, even when predetermined time t2 elapses from the activation of compressor 1, the gaps between the tip of fixed scroll lap 32 and orbiting scroll end plate 41, and between the tip of orbiting scroll lap 42 and fixed scroll end plate 31 do not decrease. Thus, the sealing performance of compression chamber 50 is poor to fail to achieve efficient compression.

This phenomenon may occur for a following reason. When ratio E/H is too large during the stoppage of compressor 1, the gaps between the tip of fixed scroll lap 32 and orbiting scroll end plate 41, and between the tip of orbiting scroll lap 42 and fixed scroll end plate 31 do not sufficiently decrease so as to improve the sealing performance of compression chamber 50. Accordingly, the pressure in compression chamber 50 does not increase with time. This is due to that even when sufficient time has elapsed since the activation of compressor 1, the force to press fixed scroll 30 onto orbiting scroll 40 does not become larger than the reactive force of elastic bodies 160.

In the case where ratio E/H is equal to or smaller than 0.005, in particular, ratio E/H is 0.002, the gaps between the tip of fixed scroll lap 32 and orbiting scroll end plate 41, and between the tip of orbiting scroll lap 42 and fixed scroll end plate 31 are generated for only a short period from the activation of compressor 1 to predetermined time t1. For this reason, immediately after the activation, complete compression starts to apply a large compression load to compressor 1 and thus, compressor 1 cannot be started with a single-phase motor having a small starting torque.

This phenomenon may occur for a following reason. When ratio E/H during the stoppage of compressor 1 is too small, the gaps between the tip of fixed scroll lap 32 and orbiting scroll end plate 41, and between the tip of orbiting scroll lap 42 and fixed scroll end plate 31 start to decrease immediately after the activation of compressor 1. Accordingly, immediately after the activation of compressor 1, the force to press fixed scroll 30 onto orbiting scroll 40 becomes larger than the reactive force of elastic bodies 160.

In the present exemplary embodiment, fixed scroll 30 is pressed onto orbiting scroll 40 by a back pressure, that is, the pressure in high-pressure space 11 to improve the sealing performance of compression chamber 50. Similarly, orbiting scroll 40 may be pressed onto fixed scroll 30 to improve the startability. However, pressing fixed scroll 30 onto orbiting scroll 40 can set a more suitable pressing force in a large operational range. This can improve the efficiency of compressor 1 while improving the startability of compressor 1

In the present exemplary embodiment, ratio E/H is a ratio of gap E between the gap between the tip of fixed scroll lap 32 of fixed scroll 30 and the upper face of orbiting scroll end plate 41 of orbiting scroll 40 to height H of fixed scroll lap 32 of fixed scroll 30. However, ratio E/H may be a ratio of a gap between the tip of orbiting scroll lap 42 of orbiting scroll 40 and the lower face of fixed scroll end plate 31 of fixed scroll 30 to height of orbiting scroll lap 42 of orbiting scroll 40.

INDUSTRIAL APPLICABILITY

The present disclosure is useful for a compressor of a refrigeration cycle apparatus used in electric products such as water heaters, hot-water heaters, and air conditioners.

REFERENCE MARKS IN THE DRAWINGS

1: compressor
10: sealed vessel
11: high-pressure space
12: low-pressure space
13: refrigerant suction tube
14: refrigerant ejection tube
15: oil reservoir
16: sub bearing
20: partition wall
21: second ejection port
22: protrusion
30: fixed scroll (non-orbiting scroll)
30H: ejection space
30M: intermediate-pressure space
31: fixed scroll end plate
32: fixed scroll lap
33: circumferential wall
34*a*: first flange
34*b*: second flange
35: first ejection port
36: bypass port
37: intermediate-pressure port
38: suction part
39: upper boss
40: orbiting scroll
41: orbiting scroll end plate
42: orbiting scroll lap
43: lower boss
50: compression chamber
60: main bearing
61: bearing part
62: boss storage part
63: return path
70: rotational shaft
71: eccentric shaft
72: oil path
73: suction opening
74: paddle
75: first oil feeding opening
76: second oil feeding opening
77: third oil feeding opening
78: swing bush
79: orbiting bearing
80: motor
81: stator
82: rotor
90: anti-rotation member (Oldham ring)
91: first key groove
92: second key groove
93: first key
94: second key
95: ring-shaped part
100: columnar member
101: scroll-side hole
102: bearing-side hole
103: scroll-side recess
104: bearing-side recess
105: flat plate
121: bypass check valve
122: bypass check valve stop
131: ejection check valve
132: ejection check valve stop
141: first seal member
142: second seal member
150: blocking member
151: ring-shaped part
152: protrusion
160: elastic body
170: compression mechanism
221: hole
310: ring-shaped projection
751: first branch oil path
761: second branch oil path

The invention claimed is:

1. A scroll compressor comprising:

a partition wall that divides a sealed vessel into a high-pressure space and a low-pressure space;

a non-orbiting scroll provided in the low-pressure space, the non-orbiting scroll being disposed adjacent to the partition wall;

an orbiting scroll that engages with the non-orbiting scroll with a compression chamber defined between the orbiting scroll and the non-orbiting scroll;

a rotational shaft that orbits the orbiting scroll;

a main bearing that supports the orbiting scroll;

a plurality of elastic bodies that bias one of the non-orbiting scroll and the orbiting scroll so as to separate the non-orbiting scroll from the orbiting scroll; and a plurality of columnar members that are fixed at one ends of the columnar members and are movable at the other ends of the columnar members with respect to the main bearing and the non-orbiting scroll, the columnar members being disposed in a circumferential direction;

wherein the non-orbiting scroll or the orbiting scroll biased by the elastic body is movable between the partition wall and the main bearing in an axial direction of the rotational shaft, the elastic bodies are disposed at a separate position from the plurality of columnar members in the circumferential direction, and an end face of each of the plurality of elastic bodies is disposed on the non-orbiting scroll and the main bearing, and the end face is disposed in a recess provided on the non-orbiting scroll and on the main bearing.

2. A scroll compressor comprising:

a partition wall that divides a sealed vessel into a high-pressure space and a low-pressure space;

a non-orbiting scroll provided in the low-pressure space, the non-orbiting scroll being disposed adjacent to the partition wall;

an orbiting scroll that engages with the non-orbiting scroll with a compression chamber defined between the orbiting scroll and the non-orbiting scroll;

a rotational shaft that orbits the orbiting scroll;

a main bearing that supports the orbiting scroll;

a plurality of elastic bodies that bias one of the non-orbiting scroll and the orbiting scroll so as to separate the non-orbiting scroll from the orbiting scroll; and a plurality of columnar members that are fixed at one ends of the columnar members and are movable at the other ends of the columnar members with respect to the main bearing and the non-orbiting scroll, the columnar members being disposed in a circumferential direction;

wherein the non-orbiting scroll or the orbiting scroll biased by the elastic body is movable between the partition wall and the main bearing in an axial direction of the rotational shaft, the elastic body is disposed at a separate position from the plurality of columnar members in the circumferential direction, the plurality of columnar members are disposed at an equal first interval in the circumferential direction, the plurality of elastic bodies are disposed at an equal second interval in the circumferential direction, and an end face of each of the plurality of elastic bodies is disposed on the non-orbiting scroll and the main bearing, and the end face is disposed in a recess provided on the non-orbiting scroll and on the main bearing.

3. The scroll compressor according to claim 2, wherein one end of each of the plurality of elastic bodies and one end of each of the plurality of columnar members are disposed at the main bearing so as to be close to each other.

4. The scroll compressor according to claim 1, wherein the end face has a flat plate.

5. The scroll compressor according to claim 1, wherein an end face of each of the plurality of the columnar members is disposed in a hole or a second recess provided on the non-orbiting scroll or the main bearing, and the recess and the hole or the second recess are provided separately in the circumferential direction.

6. The scroll compressor according to claim 1, wherein a second end face of each of the plurality of the columnar members is disposed in a hole or a second recess provided on the main bearing, the recess and the hole or the second recess are provided separately in the circumferential direction, and the end face and the second end face are disposed at the main bearing so as to be close to each other.

7. The scroll compressor according to claim 1, wherein holes receiving the plurality of columnar members pass through the non-orbiting scroll and the main bearing.

8. The scroll compressor according to claim 2, wherein the first interval is equal to the second interval.

* * * * *